US005407376A

United States Patent [19]

Avital et al.

[11] Patent Number: 5,407,376

[45] Date of Patent: Apr. 18, 1995

[54] VOICE-RESPONSIVE DOLL EYE MECHANISM

[76] Inventors: Noni Avital; Iko Avital, both of 30 Wingate St., Raanana, Israel

[21] Appl. No.: 187,519

[22] Filed: Jan. 28, 1994

[30] Foreign Application Priority Data

Jan. 31, 1993 [IL] Israel ..... 104566

[51] Int. Cl.[6] ..... A63H 30/00; A63H 3/28; A63H 3/40

[52] U.S. Cl. ..... 446/175; 446/301; 446/344; 446/345

[58] Field of Search ..... 446/175, 301, 300, 298, 446/341, 342, 343, 344, 345, 350, 352, 389, 392, 491

[56] References Cited

U.S. PATENT DOCUMENTS

| | | | |
|---|---|---|---|
| 1,061,965 | 5/1913 | Daly et al. | 446/341 |
| 2,716,839 | 9/1955 | Young | 446/341 |
| 2,948,069 | 8/1960 | Johnson | 446/175 X |
| 3,353,296 | 11/1967 | Ryan et al. | 446/344 |
| 3,440,349 | 4/1969 | Gibbs | 446/175 X |
| 3,660,932 | 5/1972 | Raffeli et al. | 446/346 |
| 4,165,581 | 8/1979 | Welf | 446/175 |
| 4,245,430 | 1/1981 | Hoyt | 446/175 |
| 4,843,497 | 6/1989 | Leyden | 446/301 X |
| 4,850,931 | 7/1989 | Sato et al. | 446/175 |

FOREIGN PATENT DOCUMENTS

| | | | |
|---|---|---|---|
| 701036 | 12/1953 | United Kingdom | 446/175 |
| 2106404 | 4/1983 | United Kingdom | 446/341 |

*Primary Examiner*—Robert A. Hafer
*Assistant Examiner*—D. Neal Muir
*Attorney, Agent, or Firm*—Edward Langer

[57] ABSTRACT

A doll eye mechanism responsive to the voice and designed as a replaceable unit provided in a toy or doll to simulate communication with a child. When the child speaks to the doll, the mechanism provides eye rotation, to simulate a human response. The mechanism comprises control circuitry which receives the voice as an input to a microphone, and converts this into a drive signal which powers a transmission designed as a motor and gears to provide rotation. The voice-responsive mechanism provides a metaphor for the natural mechanism of the brain which makes communication possible. The human eye, the organ of sight, receives the information (the child's voice) through the cornea (microphone) and passes on the message (via the control system) to the rear lobe of the brain (transmission mechanism) which coordinates the movement of the two eyes (two axes of motor). For example, a stuffed toy dog may be designed with the inventive mechanism and when the child calls the dog by its name, the dog responds by moving its eyes. The louder the child speaks to the dog, the faster the eye movement. The voice stimulus/-repeated eye response from the toy represents, in effect, "communication" between the child and the toy dog. The inventive voice-responsive mechanism may be provided in many toys and doll designs, including toy cars, stuffed animals, etc. Each item is designed with facial features, "humanizing" it to simulate communication via the eye expression. The facial features encourage voice communication, and as a result, simplified electronics sensitive to the voice frequency are usable for voice-responsive operation.

6 Claims, 8 Drawing Sheets

FIG. 11
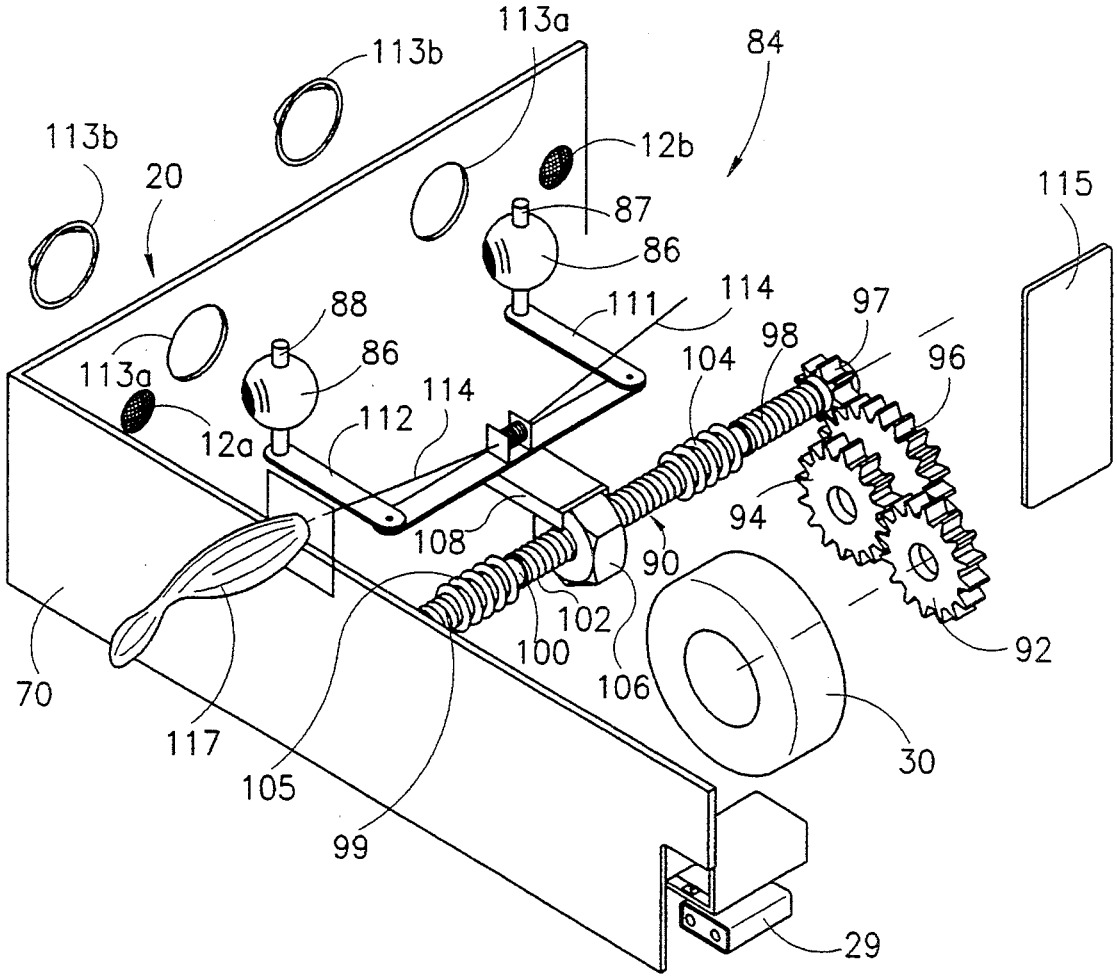
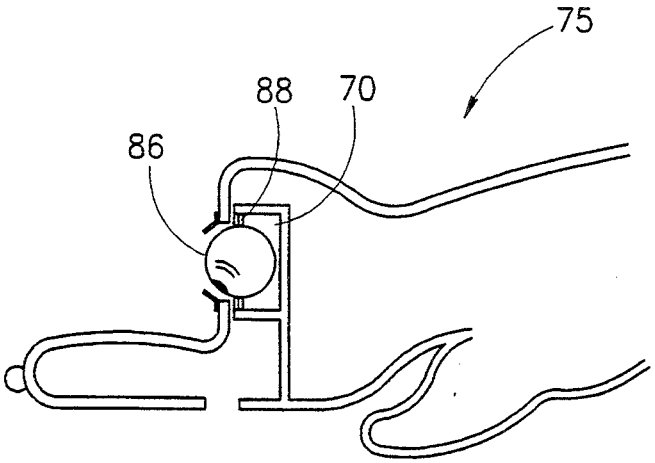
FIG. 12

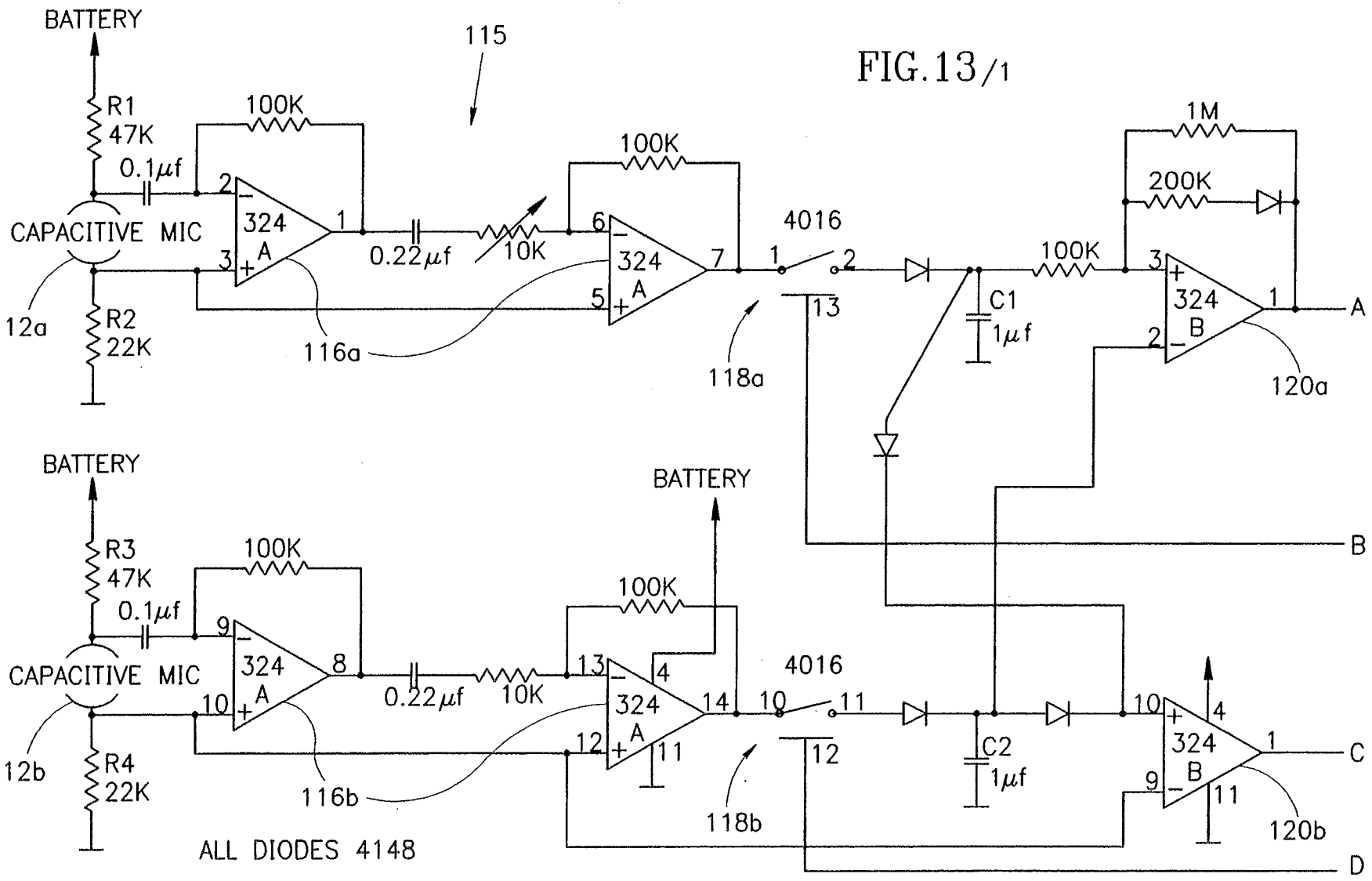
FIG. 13/1

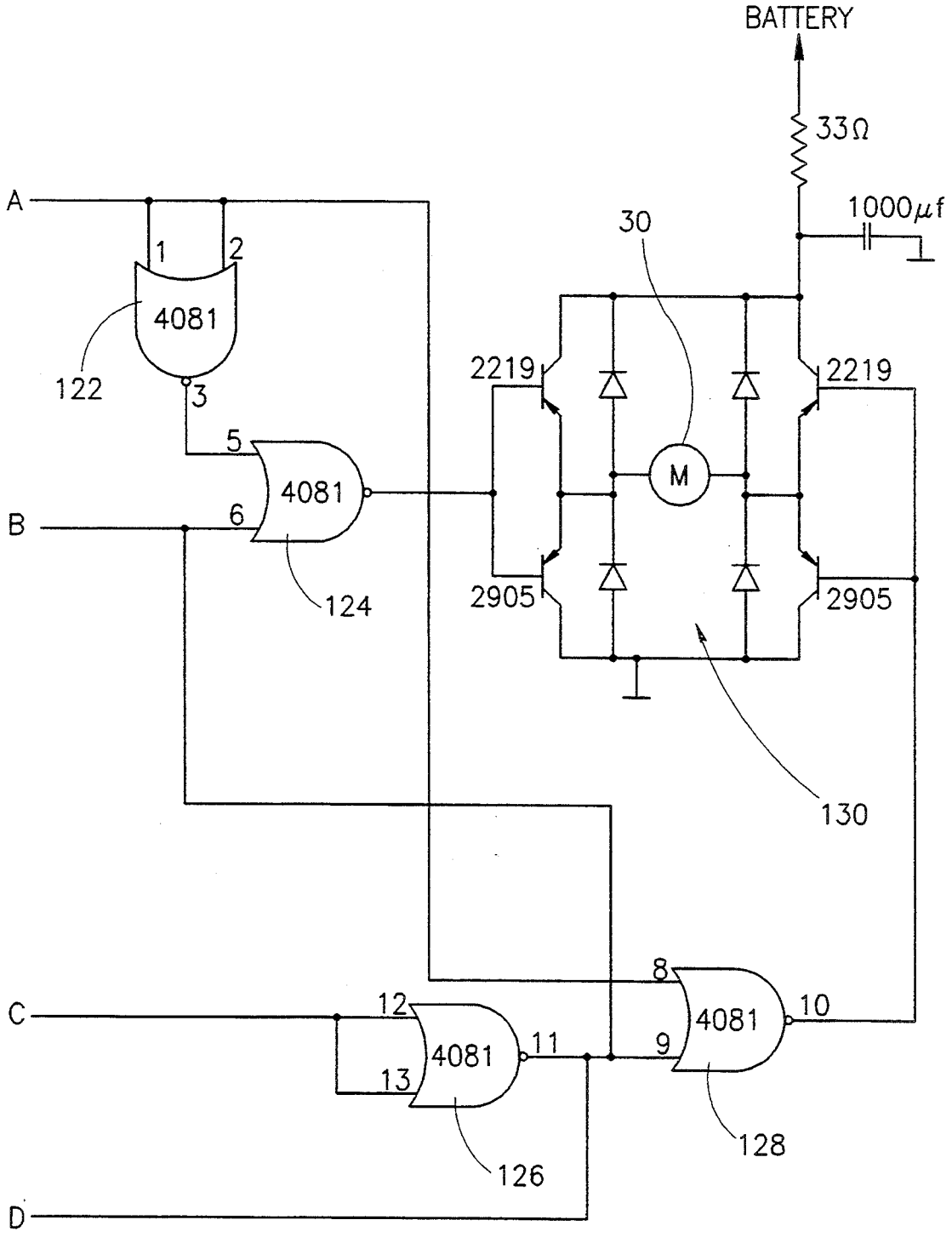
FIG. 13/2

VOICE-RESPONSIVE DOLL EYE MECHANISM

FIELD OF THE INVENTION

The present Invention relates to toys, dolls, and the like, and more particularly, to a voice-responsive doll eye mechanism for providing doll eye motion in response to a voice.

BACKGROUND OF THE INVENTION

The prior art of toy and doll design includes mechanisms for increasing the life-like appearance of dolls, such as mechanisms for providing the doll limbs with motion, or providing doll eye motion, etc. U.S. Pat. No. 4,900,289 to Curran et al. discloses mechanism for animating a dollS's facial features, incorporating motor to power jaw, eye and eyelid motion. An eye shifting mechanism for dolls is disclosed in U.S. Pat. No. 4,005,545 to King et al. A pneumatic means for providing eye motion is described in U.S. Pat. No. 3,882,631 to Benkoe et al. A doll with blinking eyelids moved by a pendulum is described U.S. Pat. No. 3,699,707 to Sapkus. A rolling doll eye weighted so a s to rotate when the head is tilted is disclosed in U.S. Pat. No. 3,664,059 to Leibowitz. A side-to-side rolling weighted doll eye is disclosed in U.S. Pat. No. 3,590,521 to Samo. Other moving doll eye mechanisms are disclosed in U.S. Pat. Nos. 3,550,315 to Samo, 3,462,875 to May, and 3,421,255 to Brudney. A doll with limb and eye movements is disclosed in U.S. Pat. No. 3,964,205 to Kuramochi.

Also included in prior art doll design are dolls which are voice-responsive, such that some doll response, such as movement of limbs, is provided in response to a voice stimulus.

Theories of early child development indicate that the eyes serve as the means for transmitting a mother's loving care and tenderness, and thus the eyes serve as the first means of communication for an infant before language is understood. Through eye contact the infant absorbs parental love and learns to associate eye contact with positive, loving and friendly feelings. Therefore, the eyes communicate love to a child, which lo is a basic need which must be satisfied for normal development.

The ability to socialize is developed by the child as part of the process of exploration, and from the age of one until three or four the child achieves control over his surroundings at a surprising rate. As a social animal, the child loves to speak, and objects around him are used as instruments for social activity, as the child speaks to them, asking them questions, etc. This is considered a play activity, but for children this is reality, as they believe in their toys, and communicate with them as if they were real and alive, through a humanization process. Toys and dolls designed with facial features such as eyes increase the child's recognition and level of familiarity, and these features assist in developing the desire for communication.

As indicated above, prior art doll and toy designs do not adequately address the child's need for voice-responsive communication via the channel recognized by children, the eyes.

Thus, it would be desirable to provide a children's doll or toy that assists in child development by enabling for voice-responsive communication Involving eye contact.

SUMMARY OF THE INVENTION

Accordingly, it is a principal object of the present invention to provide a children's toy or doll having eye elements and a voice-responsive mechanism for rotating the eye elements to simulate a human response.

It is another object of the invention to provide a voice-responsive eye rotation unit which can be adapted for use in many applications and with many toy designs.

In accordance with a preferred embodiment of the invention, there is provided a voice-responsive doll eye mechanism comprising:

- a housing supporting at least one rotatable doll eye element;
- rotational transmission means mounted in said housing and coupled to said eye element for rotation thereof; and
- voice-responsive control means for driving said transmission means,
- such that in response to an audible voice, said control means drives said transmission means and rotates said eye element.

In the preferred embodiment, said voice-responsive doll eye mechanism is designed as a replaceable unit provided in a toy or doll to simulate communication with a child. When the child speaks to the doll, the mechanism provides eye rotation, to simulate the human response. The control means receives the voice as an input to a microphone, and converts this into a drive signal which powers the transmission and causes eye rotation.

The transmission means may be designed as a motor and gears to provide rotation. Alternatively, the transmission means can be provided as a solenoid and toothed cam, or wound spring, or pneumatic valve using a source of compressed air.

The inventive voice-responsive mechanism provides a metaphor for the natural mechanism of the brain which makes communication possible. The human eye, the organ of sight, receives the information (the child's voice) through the cornea (microphone) and passes on the message (via the control system) to the rear lobe of the brain (transmission mechanism) which coordinates the movement of the two eyes (two axes of motor).

For example, a stuffed toy dog may be designed with the inventive mechanism and when the child calls the dog by its name, the dog responds by moving its eyes. The louder the child speaks to the dog, the faster the eye movement. When the child stops speaking, the eye movements of the toy dog cease, and a new look appears in the dog's eyes, stimulating the child to speak again. The voice stimulus/repeated eye response from the toy represents, in effect, "communication" between the child and the toy dog.

The inventive voice-responsive mechanism may be provided in many toys and doll designs, including toy cars, stuffed animals, etc. Each item is designed with facial features, "humanizing" it to simulate communication via the eye expression. The facial features encourage voice communication, and as a result, simplified electronics sensitive to the voice frequency are usable for the mechanism to be voice-responsive in operation.

Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which:

FIGS. 11–12 show another eye rotation mechanism design; and

FIG. 13 is an electronic schematic diagram of a control circuit for the eye rotation mechanism of FIGS. 11–12.

DETAILED DESCRIPTION OF THE PREFERRED EMBODIMENTS

Figure 1:
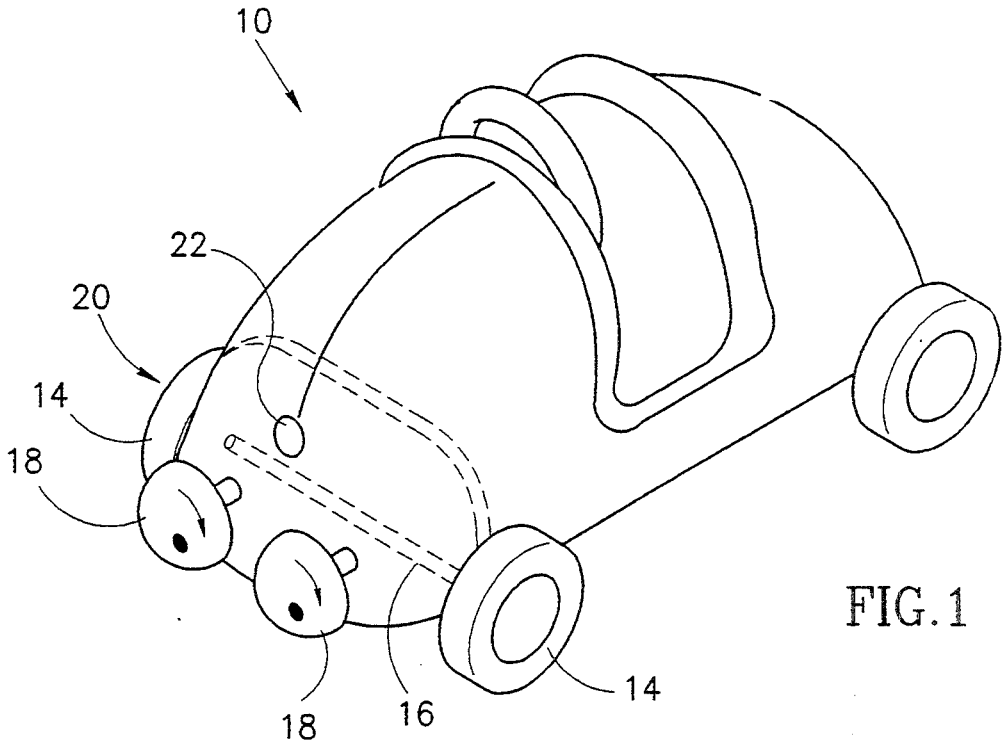
FIG. 1 is a perspective view of a toy car item having an eye rotation mechanism constructed and operated in accordance with the principles of the present invention.

Referring now to FIG. 1, there is shown a perspective view of a toy car item 10 constructed and operated in accordance with the principles of the present invention. Item 10 has a pair of front wheels 14 connected by an axle 16, and a pair of eye elements 18 mounted in its front end 20 and arranged for rotation simultaneous with axle 16. A microphone 22 placed in front end 20 detects a voice input.

Figure 2:
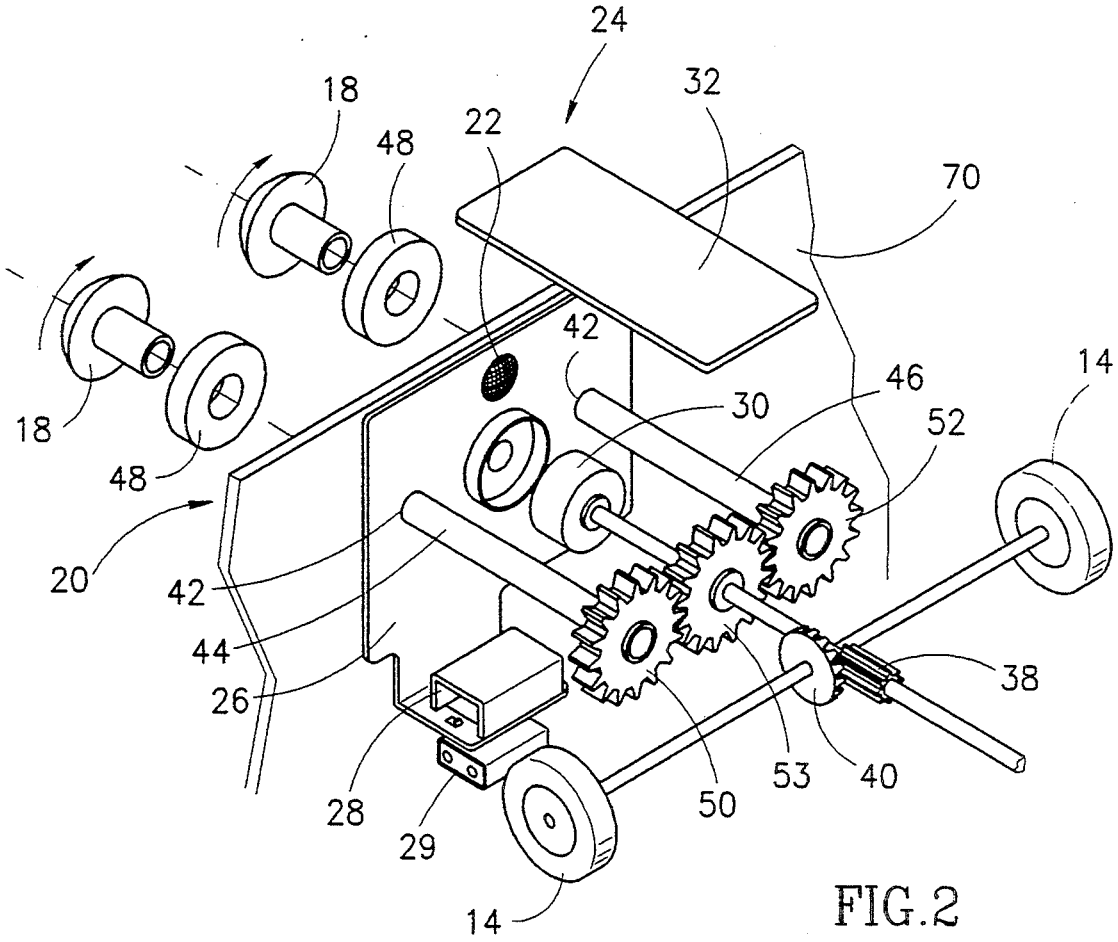
FIG. 2 is an exploded perspective view of the eye rotation mechanism used in the toy item of FIG. 1.

In FIG. 2, there is shown an exploded perspective view of an eye rotation mechanism 24 for use in the toy car 10 of FIG. 1. Mechanism 24 comprises a bracket 26 mounted to front end 20, with a lower end shaped as a holder 28 for battery 29. A motor 30 is mounted on bracket 26 in motor housing, and motor 30 is connected so as to receive power and control signals from control circuitry 32, which is in turn connected to battery 29. A microphone 22 is connected to provide voice input signals to control circuitry 32.

A shaft 36 extends rearwardly from motor 30 to power rotation of wheels 14, by engagement of a pinion gear 38 and transmission gear 40. A set of holes 42 are formed in bracket 26 through which pass shafts 44 and 46, to which there are mounted eye elements 18, each of which is seated in a protective cup 48. The other ends of shafts 44–46 are each fitted with respective gears 50–52, which engage drive gear 53 on shaft 36.

As further described herein, the operation of control circuitry 32 and motor 30 is such that when control circuitry 32 receives voice input signals from microphone 34, motor 30 rotates and shaft 36 drives the rotation of eye elements 18 via drive gear 53, gears 50–52 and shafts 44–46. Shafts 44–46 are arranged such that eye elements 18 rotate in the same direction (shown as clockwise in FIG. 1). The use of a central shaft 36 enables an additional function to be performed, via pinion gear 38 which drives rotation of wheels 14 simultaneous with eye rotation.

It will be appreciated that with minor modifications, only one eye element may be rotated, by removing a shaft 44 or 46.

Figure 3:
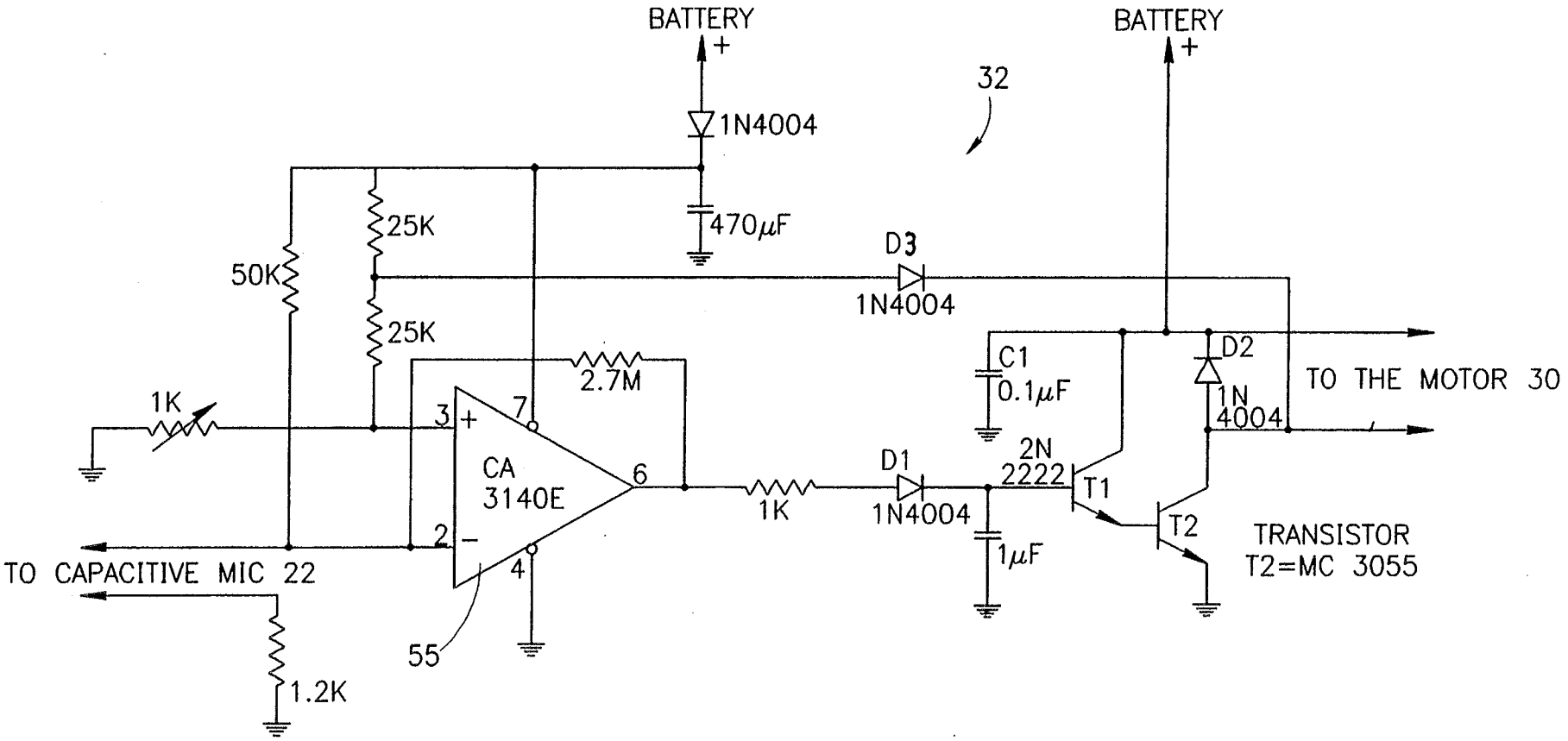
FIG. 3 is an electronic schematic diagram of a control circuit for the eye rotation mechanism of FIGS. 1–2.

FIG. 3 shows an electronic schematic diagram of control circuitry 32 for operation of eye rotation mechanism 24. Control circuitry 32 comprises an amplifier 55 such as IC type CA3140E, and an output stage comprising transistors T1 and T2 in a Darlington trigger. Transistor T1 may be a 2N 2222 type, and T2 may be an MC 3055 type. Motor 30 is connected to the output stage and is powered by battery 29 when transistor T2 is ON.

In operation, when a voice is detected by microphone 22, it provides an output voice signal to amplifier 55, and this signal is amplified and provided as an output signal on pin 6 to drive the base of transistor T1. The output signal is rectified by diode D1, that a pulsed waveform conforming to the voice pattern drives transistor T1. When driven to saturation, transistor T1 drives transistor T2, providing battery 29 power to motor 30. Diode D2 prevents reverse EMF across motor 30.

When motor 30 rotates, the diode D3 shuts off IC amplifier 55. Motor 30 rotates a partial revolution with each pulse. Capacitor C1 is provided to reduce signal noise.

Thus, by combination of the operation of eye rotation mechanism 24 with electronic control circuitry 32 in a toy or doll, eye elements 18 are made to rotate in response to a sound or voice, providing the effect of communication via a voice stimulus/eye response. In the toy car embodiment, the child gives the command "GO" and the car moves while the eyes rotate, and as the child continues to call commands to the car, it responds.

The facial features provided as eye elements 18 encourage voice communication, and as a result, control circuitry 32 uses simplified electronics sensitive to the voice frequency, enabling voice-responsive eye rotation mechanism 24 operation. Since the device imitates a "face", the child initiates a conversation, and so the voice communication is a natural result.

Figure 4:
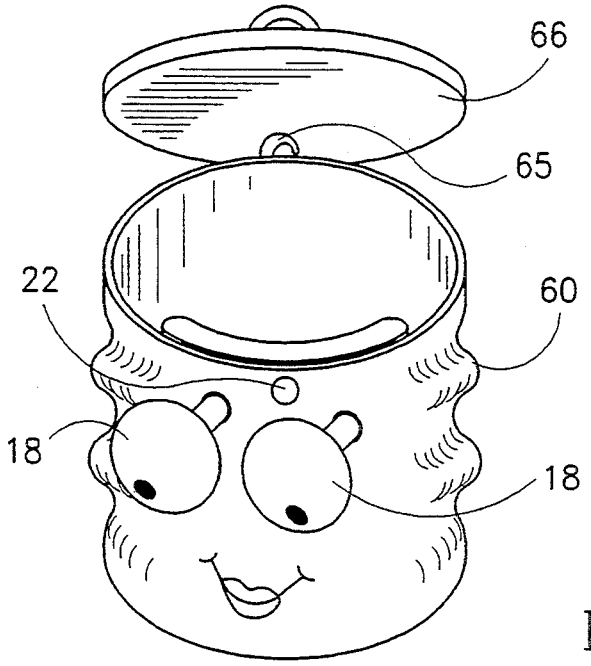
FIG. 4 is a perspective view of a cookie jar item incorporating a modified eye rotation mechanism.
Figure 5:
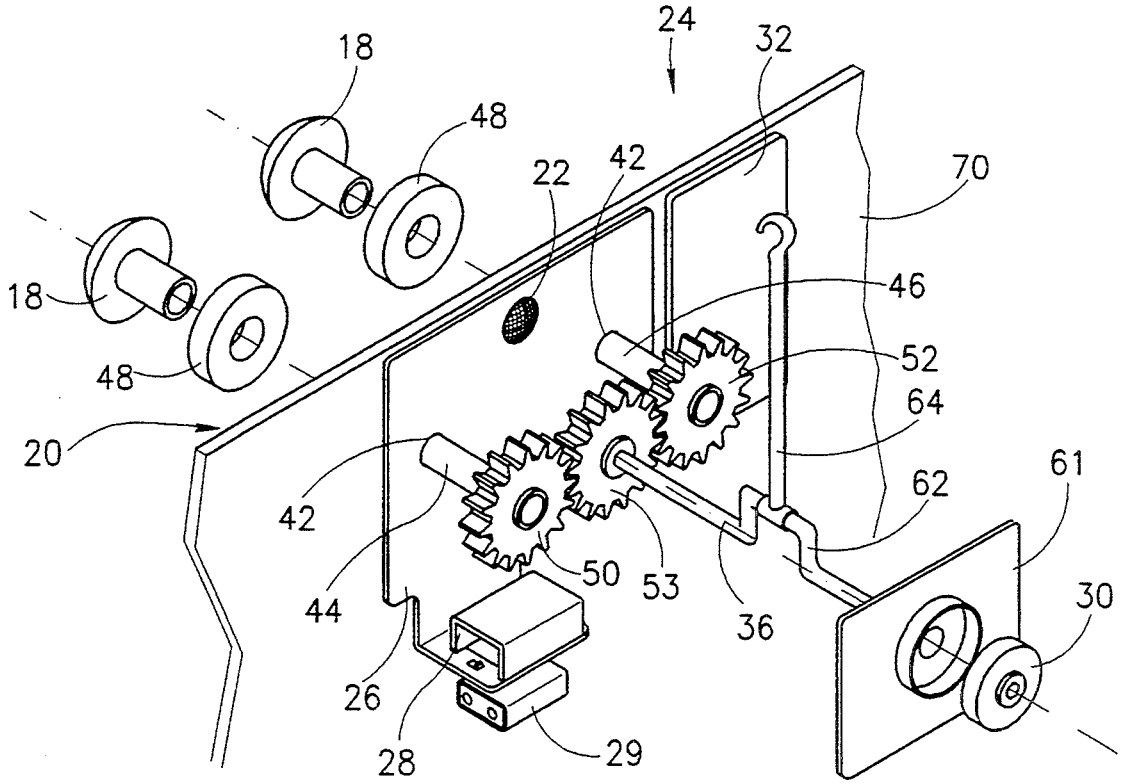
FIG. 5 is an exploded perspective view of the modified eye rotation mechanism of FIG. 4.

In FIG. 4, another toy embodiment is shown as a cookie jar 60 featuring a modified eye rotation mechanism 24 (FIG. 5). Motor 30 is mounted on a plate 61 behind bracket 26, and shaft 36 is provided with an offset portion of its length forming a crankshaft 62. A rod 64 is connected to crankshaft 62 and extends vertically therefrom, terminating in a hook 65 which engages the underside of a lid 66 on a cookie jar 60. As before, when microphone 22 detects a voice, motor 30 rotates and shaft 36 drives the rotation of eye elements 18, while rod 64 moves with reciprocating vertical motion, opening and closing jar 60 lid 66.

Figure 6:
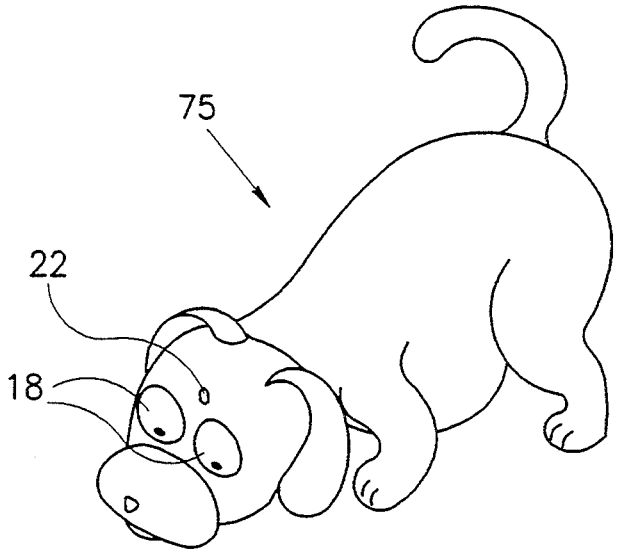
FIG. 6 is a perspective view of another alternative toy dog item featuring another modified eye rotation mechanism.
Figure 7:
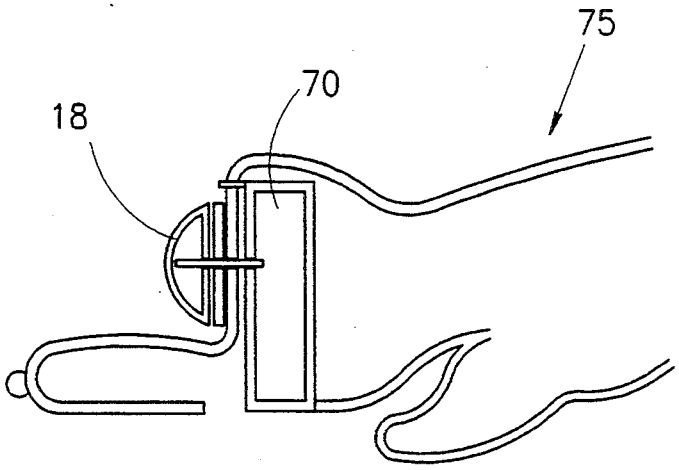
FIG. 7 is a side view of the toy item of FIG. 6.
Figure 8:
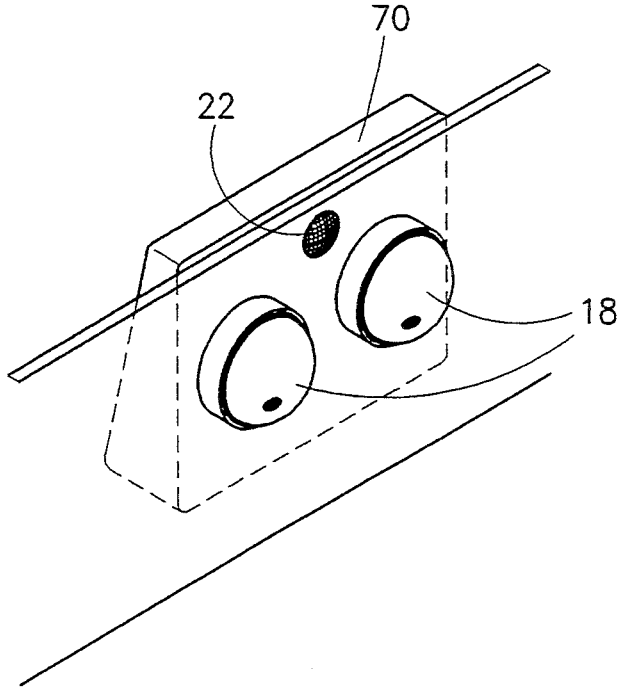
FIG. 8 is a perspective view of a housing for the eye rotation mechanism of FIG. 6.
Figure 9:
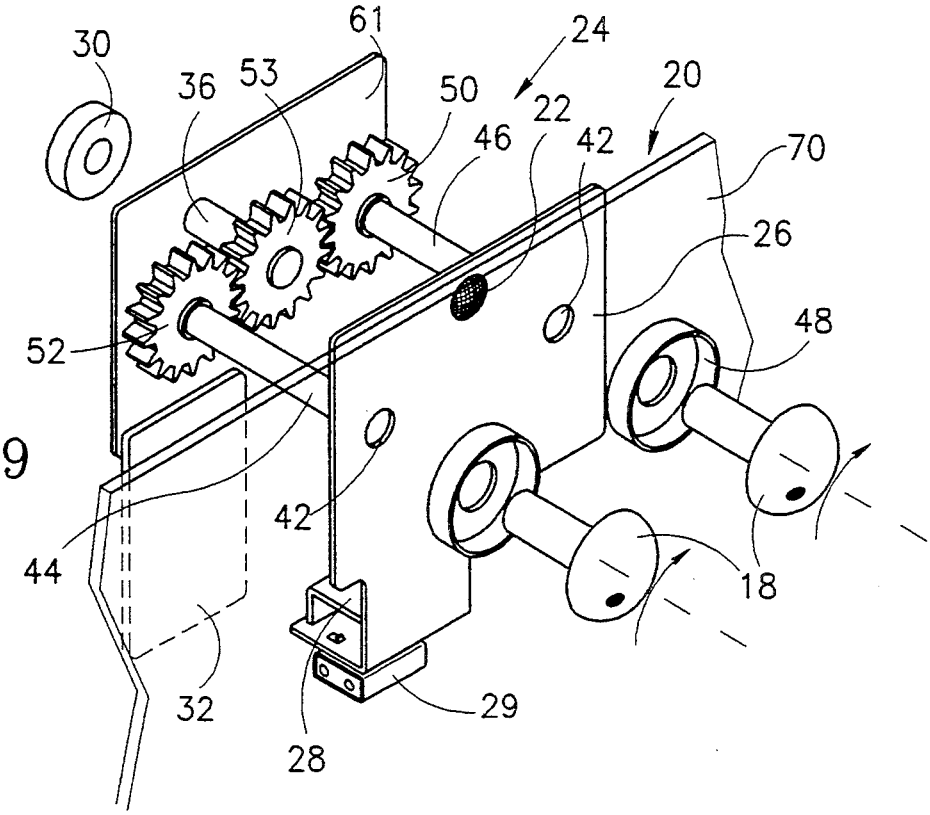
FIG. 9 is an exploded perspective view of the eye rotation mechanism used in the embodiment of FIG. 6.

In FIGS. 6–7, there are shown perspective and side views of another toy embodiment featuring a stuffed toy dog 75. In this embodiment, eye rotation mechanism 24 (FIG. 9) is modified with a straight shaft 36 and as shown In FIG. 8, eye rotation mechanism 24 can be provided in a housing 70 in the dog's head. Housing 70 can be provided a self-contained "black box" unit usable in a wide variety of other toy designs, for example, a jewelry box, toy box, roulette games, etc. FIG. 9 shows an eye rotation mechanism 24 similar to that of FIG. 2.

In the stuffed dog design of FIGS. 6–9, the child calls the dog by a name, and the dog responds by moving its eyes. The louder the child speaks to the dog (or the louder the noises in the vicinity), the faster the dog moves its eyes. When the child stops speaking, the eye movements cease and a new look appears in the dog's eyes, stimulating the child to obtain a further response. Repeating the stimulation/response sequence effectively establishes "communication" between the child and the toy dog 75.

Figure 10:
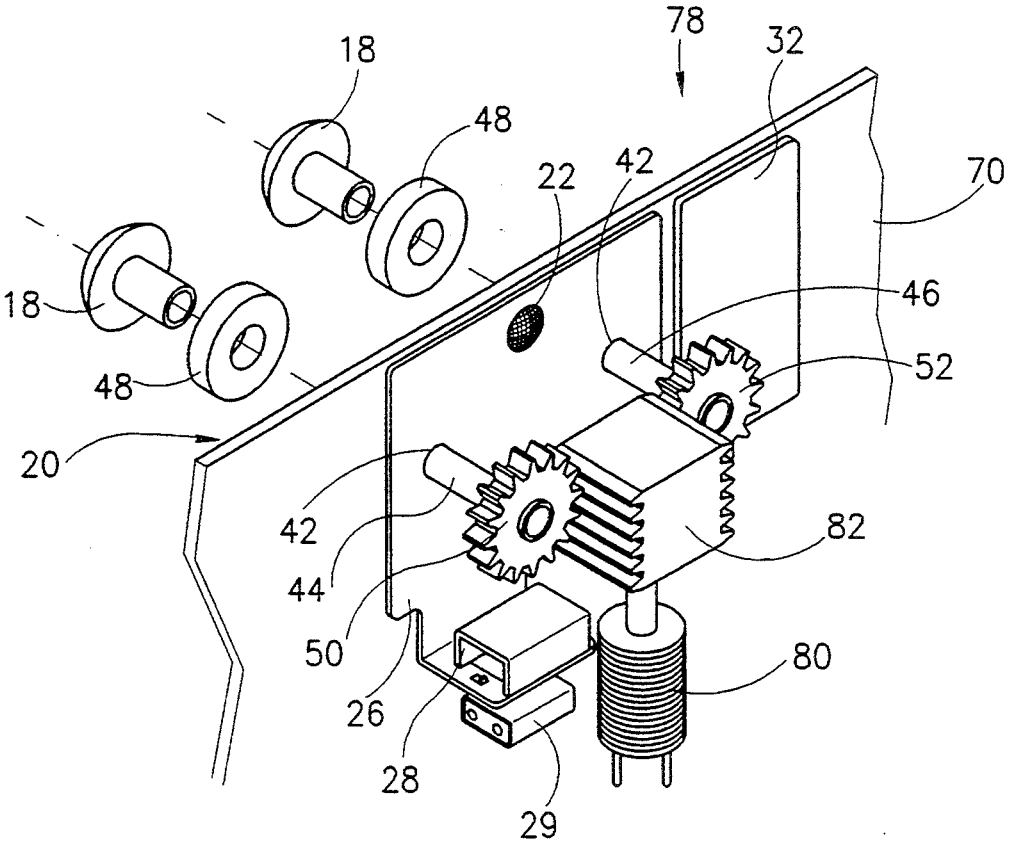
FIG. 10 is an alternative eye rotation mechanism design.

An alternative eye rotation mechanism 78 is shown in FIG. 10, featuring a solenoid 80 and a toothed cam 82 which replaces motor 30. Vertical motion of cam 82 causes shafts 44–46 to rotate. Control circuit 32 can be easily modified to periodically reverse the direction of motion of cam 82.

It will be appreciated by those skilled in the mechanical arts that the eye rotation mechanism can be designed to operate with alternative sources of rotational power other than a motor or solenoid, such as wound spring, or a pneumatic system using compressed air, or a system of weights, etc.

In FIGS. 11–12, there are shown exploded perspective and cross-sectional views of another embodiment of the inventive eye rotation mechanism 84, for providing side-to-side rotation of spherical eye elements 86. Eye rotation mechanism 84 can be mounted in housing 70 and used in any of the previous embodiments such as FIGS. 1, 4 and 6.

Unlike eye rotation mechanism 24 providing eye rotation in a plane, mechanism 84 provides side-to-side rotation of eye elements 86 about vertical pivots 87, 88 which are perpendicular to a drive shaft 90. Mechanism 84 comprises motor 30 and drive shaft 90 offset therefrom, with a set of reduction gears 92–96 provided to transmit rotational power to drive shaft 90 via engagement of a drive gear 97 mounted at an end of drive shaft 90.

Drive shaft 90 is constructed with threaded end portions 98, 99 at either end thereof and integrally formed therewith, and with an inner shaft portion 100 extending between portions 98, 99. Slidably mounted over inner shaft portion 100 is a threaded shaft portion 102, to which there is attached at either end thereof a coil spring 104, 105 connected to respective portions 98, 99. Thus, rotational power of drive shaft 90 is transmitted to threaded shaft portion 102 via coil springs 104, 105, each of which becomes compressed as it is wound by rotation.

A nut 106 threaded on shaft portion 102 fixedly supports one end of a carriage 108, which extends forwardly to fixedly support a connecting arm 110 at its other end. Rotation of threaded shaft portion 102 causes nut 106 to move laterally thereon, resulting in connecting arm 110 motion parallel to drive shaft 90. A pair of arms 111, 112 are pivotally joined at either end of connecting arm 110, and each of arms 111, 112 is fixedly connected at its free end to a respective one of vertical pivots 87, 88 asssociated with each of spherical eye elements 86.

Thus, lateral motion of nut 106 on threaded shaft portion 102 and the resulting connecting arm 110 motion causes arms 111, 112 to rotate eye elements 86 about respective vertical pivots 87, 88. As a result, eye elements 86 rotate side-to-side in housing sockets 113*a*, under covers 113*b*, depending on the direction and speed of connecting arm 110 motion. Coil springs 104, 105 limit the range of travel of threaded shaft portion 102 as it slides on inner shaft portion 100. A wire 114 attached under tension to bracket 103 moves with movement of arm 110, causing motion of other toy parts, such as a tail 117.

In FIG. 13, there is shown an electronic schematic diagram of control circuitry 115 for operation of eye rotation mechanism 84. Control circuitry 115 comprises a pair of microphones 12*a,b* each having an impedance forming a part of a voltage divider network with resistors R1-R2 and R3-R4, with each microphone output being connected at the input of an amplifier-filter 116*a,b*. The respective outputs of amplifier-filters 116*a,b* at pins 7 and 14 are fed via electronic switches 118*a,b* to voltage comparators 120*a,b*, and then via logic gates 122–128 to a motor drive circuit 130 comprising a transistor bridge inverter which controls the speed and direction of motor 30 rotation.

In operation, when a voice is detected by either of microphones 12*a,b*, an audio signal level is produced at the respective output of amplifier-filters 116*a,b*. Electronic switches 118*a,b* are normally closed, so that the capacitors C1 and C2 are charged. The voltage developed on capacitor C1 is fed to voltage comparator 120*b*, which compares the audio level at pin 10 with the voltage established at pin 9 by the voltage divider R3-R4 on the input. Assuming a sufficient audio level exists, gate 126 provides an output at pin 11 to electronic switches 18*a,b* causing them to open and isolating microphones 12*a,b* from the circuit, thus eliminating feedback of motor 30 rotation noise.

At the same time, voltage comparator 120*a* compares the audio output of the pair of amplifier-filters 116*a,b* to determine which has the higher output level, to provide a directional indication of the location from which the voice originated. Based on the operation of logic gates 122–128, motor drive circuit 130 operates to control the motor 30 speed and direction. Thus, the side-to-side rotation direction of eye elements 86 is determined.

The overall effect of the operation of eye rotation mechanism 84 is to cause side-to-side rotation of eye elements 86 in the direction of the location from which the voice originated, to simulate communication via a voice stimulus/eye response. The eye elements 86 may be designed as bulbs providing illumination.

The circuit 115 can be modified by elimination of one of the two microphones 12*a,b* and motor drive circuit 130 can be modified to automatically reverse direction of motor rotation in periodic fashion so that in response to a voice stimulus from any direction, side-to-side rotation of eye elements 86 is performed.

Having described the invention with regard to certain specific embodiments, it is to be understood that the description is not meant as a limitation since further modifications may now suggest themselves to those skilled in the art and it is intended to cover such modifications as fall within the scope of the appended claims.

We claim:

1. A voice-responsive doll eye mechanism comprising:

a housing supporting a pair of side-to-side rotatable doll eye elements;

rotatable transmission means mounted in said housing and coupled to said eye elements to enable side-to-side rotation thereof, wherein said rotatable transmission means comprises:

a motor arranged to drive rotation of a threaded shaft;

a nut threaded on said shaft for movement thereon;

a connecting arm fixedly supported by said threaded nut and arranged to slide parallel to said shaft; and pair of pivot arms connected to opposite ends of said connecting arm and coupled to said pair of rotatable eye elements for providing side-to-side rotation thereof as said shaft rotates and said connecting arm slides with motion of said threaded nut on said shaft, and voice-responsive control means for driving said transmission means, said voice-responsive control means comprising simplified electronic circuitry including a battery, a pair of microphones spaced apart on said housing, an amplifier-filter, a signal level comparator and a set of logic gates for comparing an output of each microphone to determine an origination location of said voice and developing an output signal in accordance therewith for providing directional motion of said transmission means, said output signal polarity being periodically reversed automatically to reverse said motion, such that in response to an audible voice, said control means drives said transmission means and provides side-to-side rotation of said pair of eye elements.

2. The mechanism of claim 1 wherein said housing provides a self-contained unit for mounting in toys, dolls and the like.

3. The mechanism of claim 1 wherein a pair of eye elements are used as facial features, to stimulate a voice communication.

4. The mechanism of claim 1 wherein said eye element comprises a bulb providing illumination when rotated.

5. The mechanism of claim 1 further comprising a wire attached to said threaded nut and connected under tension to a movable element of said housing comprising a toy part, motion of said threaded nut causing motion of said movable element.

6. A voice-responsive doll eye mechanism comprising:

a housing supporting a pair of side-to-side rotatable doll eye elements;

rotatable transmission means mounted in said housing and coupled to said eye elements to enable side-to-side rotation thereof, wherein said rotatable transmission means comprises:

a motor arranged to drive rotation of a threaded shaft;

a nut threaded on said shaft for movement thereon;

a connecting arm fixedly supported by said threaded nut and arranged to slide parallel to said shaft; and a pair of pivot arms connected to opposite ends of said connecting arm and coupled to said pair of rotatable eye elements for providing side-to-side rotation thereof as said shaft rotates and said connecting arm slides with motion of said threaded nut on said shaft; and voice-responsive control means for driving said transmission means, said control means comprising simplified electronic circuitry including a power source and a spaced apart pair of microphones on said housing sensitive to a user's voice to determine an origination location of the voice and developing an output signal in accordance therewith, thereby providing directional control of said transmission means, such that in response to the user's voice, said control means drives said transmission means and provides side-to-side rotation of said pair of eye elements.

* * * * *